US007318318B2

(12) United States Patent
Roth

(10) Patent No.: US 7,318,318 B2
(45) Date of Patent: Jan. 15, 2008

(54) SUPERCONDUCTING MAGNET SYSTEM WITH REFRIGERATOR

(75) Inventor: Gerhard Roth, Rheinstetten (DE)

(73) Assignee: Bruker BioSpin GmbH, Rheinstetten (DE)

( * ) Notice: Subject to any disclaimer, the term of this patent is extended or adjusted under 35 U.S.C. 154(b) by 413 days.

(21) Appl. No.: 11/055,069

(22) Filed: Feb. 11, 2005

(65) Prior Publication Data

US 2006/0064989 A1 Mar. 30, 2006

(30) Foreign Application Priority Data

Mar. 13, 2004 (DE) ..... 10 2004 012 416
Oct. 9, 2004 (EP) ..... 04024133

(51) Int. Cl.
*F25B 9/00* (2006.01)
*F25B 19/00* (2006.01)

(52) U.S. Cl. ..... 62/6; 62/51.1; 62/51.2

(58) Field of Classification Search ..... 62/6, 62/51.1, 51.2, 48.2
See application file for complete search history.

(56) References Cited

U.S. PATENT DOCUMENTS 4,279,127 A * 7/1981 Longsworth ..... 62/77
5,220,800 A * 6/1993 Muller et al. ..... 62/51.1
5,381,666 A * 1/1995 Saho et al. ..... 62/47.1
5,721,522 A * 2/1998 Roth et al. ..... 335/216
5,744,959 A * 4/1998 Jeker et al. ..... 324/319
6,038,867 A * 3/2000 Einziger et al. ..... 62/45.1
6,107,905 A 8/2000 Itoh
6,197,127 B1 * 3/2001 Okamura et al. ..... 148/301
6,334,909 B1 * 1/2002 Okamura et al. ..... 148/303
6,804,968 B2 10/2004 Strobel
2005/0202976 A1 * 9/2005 Killoran ..... 505/200
2005/0229609 A1 * 10/2005 Kirichek et al. ..... 62/6

FOREIGN PATENT DOCUMENTS

DE 199 24 184 11/2000

OTHER PUBLICATIONS

US 5,774,959, 4/1998, Jeker (withdrawn).

* cited by examiner

*Primary Examiner*—William C Doerrler
(74) *Attorney, Agent, or Firm*—Paul Vincent

(57) ABSTRACT

A cryostat (1) with a first helium tank (4) which contains helium at an operating temperature $T_1$<3K, and a second helium tank (2) which is connected to the first helium tank (4) and contains liquid helium at an operating temperature $T_2$>3K, wherein a cooling means (6) is provided in the first helium tank (4) which generates an operating temperature $T_1$<3K in the first helium tank (4), wherein the cooling means (6) is designed as a Joule-Thomson valve with downstream heat exchanger from which pumped helium is transported to a room temperature region outside of the cryostat (1) is characterized in that a refrigerator (11) is provided whose cold end (19) projects into the second helium tank (2) and the supplied helium is returned during normal operation in a closed loop along the refrigerator (11) and into the second helium tank (2), thereby being pre-cooled and liquefied at the cold end (19) of the refrigerator (11). The inventive cryostat minimizes helium consumption, thereby permitting continuous measuring operation.

20 Claims, 3 Drawing Sheets

SUPERCONDUCTING MAGNET SYSTEM WITH REFRIGERATOR

This application claims Paris Convention priority of DE 10 2004 012 416.7 filed Mar. 13, 2004 and of EP 040 241 33.3 filed Oct. 9, 2004 the entire disclosure of which are both hereby incorporated by reference.

BACKGROUND OF THE INVENTION

The invention concerns a cryostat with a first helium tank which contains helium at an operating temperature T1<3 K, and a second helium tank which is connected to the first helium tank, and contains liquid helium at an operating temperature $T_2$>3 K, wherein the first helium tank has a cooling means which generates an operating temperature $T_1$<3 K in the first helium tank, wherein the cooling means is designed as a Joule-Thomson valve with downstream heat exchanger and supplies pumped helium to a room temperature region outside of the cryostat. A magnet system of this type is disclosed in U.S. Pat. No. 5,220,800.

Superconducting magnet systems of this type generally comprise a cryostat with two chambers, with a superconducting magnet coil being disposed in the first chamber. The second chamber serves as a helium supply which is under atmospheric pressure or slight overpressure at a temperature of approximately 4.2 K. The two chambers communicate and helium can flow from the upper into the lower chamber where it is cooled to a temperature considerably below 4.2 K using a further cooling unit which projects into the first chamber. A radiation shield reduces the impinging radiation energy and includes a tank which is filled with a cryogenic liquid and cools the radiation shield.

There are conventional further cooling units to further cool the liquid helium in the first chamber, wherein the helium is relaxed through a needle valve to a low pressure and is pumped out of the first chamber. Disadvantageously, the pumped helium is removed from the system such that the second chamber, which is connected to the first chamber, is slowly emptied and the helium in the second chamber must be replaced at regular intervals.

Refrigerators are conventionally used to cool the helium in cryostats with one chamber or also to cool radiation shields, wherein a working gas is expanded or compressed using a piston motion (piston refrigerator). Disadvantageously, the permanent piston motion generates vibrations and also causes magnetic disturbances in the main magnetic field of the coil due to the metallic piston. The motion of the piston at the cold end of the refrigerator is also problematic, since lubrication is not possible due to the low temperature, resulting in the need for frequent maintenance.

In contrast thereto, pulse tube coolers effect expansion or compression of the working gas using a shock wave front in a pulse tube. The shock wave front is thereby controlled by a suitable valve arrangement, usually by a rotating valve. The pulse tube is connected to a regenerator in which heat exchange between the working gas and the regenerator material is provided. After compression of the working gas, the gas flows through the regenerator and is then relaxed in the expansion chamber. The gas which is cooled thereby accepts heat from the surroundings of the expansion chamber thereby cooling those surroundings. Since the rotating valve must not be disposed in the direct vicinity of the magnet system, a pulse tube cooler represents a smoothly running, low-wear cooling means which avoids moving parts in the low-temperature region.

In the magnet system of U.S. Pat. No. 5,220,800, the further cooling unit which projects into the first chamber pumps liquid helium to further cool the liquid helium bath in the first chamber via expansion. A disadvantage of this arrangement is that the refrigerator permanently consumes helium. This is particularly disadvantageous, since measurements must be interrupted to refill the helium and this involves considerable expense. Moreover, helium is not always available in arbitrary amounts. For this reason, it is desirable to reduce the helium consumption of a magnet arrangement of this type.

It is therefore the underlying purpose of the invention to present a superconducting magnet system which minimizes the helium consumption thereby omitting unnecessary interruption of measurements due to frequent refilling of helium.

SUMMARY OF THE INVENTION

This object is achieved in accordance with the invention by providing a refrigerator whose cold end projects into the second helium tank, and by returning the supplied helium in a closed loop via the refrigerator into the second helium tank during normal operation, which is thereby pre-cooled and liquefied at the cold end of the refrigerator.

As in prior art, liquid helium can be pumped via a cooling means in the first tank. Expansion of the helium through a Joule-Thomson valve and heat exchange in the downstream heat exchanger further cools the liquid helium in the first tank. However, in contrast to conventional arrangements, the expanded helium of the inventive magnet system does not flow out of the system, rather can be re-supplied to the second helium tank in a closed loop. The expanded helium is re-liquefied using the refrigerator disposed in the second helium tank and brought to the temperature of the helium located in the second helium tank. The helium consumption is substantially minimized in the inventive system thereby allowing continuous measurement operation.

The invention realizes a vapour-free or at least low-vapour superconducting magnet system, wherein helium removed from the magnet system during cooling is returned to the second tank within a closed system thereby avoiding unnecessary helium loss. For this reason, the magnet system is operated with less helium, optimally without any helium, besides the helium located already in the tank. The inventive system therefore permits continuous measuring operation and eliminates the need for helium refilling. Moreover, the second helium tank may have smaller dimensions compared to conventional magnet systems due to the reduced helium consumption. This reduces the overall size of the apparatus.

The advantages of the inventive cryostat are optimally utilized if the cryostat in the first helium tank contains a superconducting magnet system, in particular a magnetic resonance apparatus.

In an advantageous embodiment, the refrigerator is designed as a pulse tube cooler. The use of a pulse tube cooler in the second helium tank reduces disturbances of the main magnetic field.

In a preferred embodiment of the cryostat, the refrigerator has several stages, preferably two stages. The helium in the second tank can be cooled down to its boiling temperature of 4.2 K and thereby be liquefied by means of a multi-stage refrigerator.

In a particularly preferred embodiment of the invention, one stage of the refrigerator upstream of the cold end is thermally conductingly connected to a radiation shield disposed in the cryostat. The radiation shield may thereby be cooled with the refrigerator stage connected thereto.

In a particularly advantageous manner, the radiation shield connected to the stage of the refrigerator surrounds the helium tank and the cooling power of the refrigerator is sufficient to replace a tank of liquid nitrogen. In this case, the arrangement need not be supplied with liquid nitrogen. Moreover, the arrangement may be more compact due to avoidance of a nitrogen tank.

In the low temperature stage, the refrigerator preferably contains a regenerator material substance with a phase transition at a low temperature in the region of around 4 K or less, in particular a magnetic phase transition. The phase transition causes an increase in the specific heat of the regenerator material such that even at very low temperatures (T<4 K), heat discharge from the working gas to the regenerator material is possible.

In particular, for regenerator materials with a magnetic phase transition, it is advantageous to magnetically shield the regenerator material in the cryostat, whereby disturbance of the main field by magnetic phase transitions can be prevented.

In a further embodiment of the invention, the refrigerator contains a regenerator material substance with a non-magnetic phase transition. These regenerator materials have no disturbing effect in magnetic applications.

In a special embodiment, the refrigerator in the low-temperature stage additionally or exclusively contains stationary helium as the regenerator material. Helium has no magnetic phase transition and is relatively inexpensive compared to other conventional regenerator materials. The use of helium under high pressure as regenerator material is already disclosed in DE 199 24 184 A1.

In a particularly preferred embodiment of the invention, the section of the refrigerator which contains the regenerator is disposed at a location in the cryostat which has a minimum magnetic field during operation, e.g. in the radial space between a main and shielding coil of the magnet arrangement or radially outside of the magnet coil approximately in the region of its center plane. Interaction between the regenerator material and the main magnetic field is thereby minimized.

The cryostat and refrigerator are preferably designed and dimensioned such that no additional helium must be refilled in the cryostat during operation. This increases the user friendliness of the cryostat and permits continuous operation of the magnet arrangement over very long time periods.

In a preferred embodiment, the second helium tank is disposed above the first helium tank. The second helium tank can thereby serve the hydrostatic function of keeping the first helium tank at atmospheric pressure.

In a particularly preferred embodiment of the invention, the closed helium loop comprises a return line to return the supplied helium, the return line having a pressure compensation container, preferably outside of the cryostat. The pressure compensation container can compensate for operational fluctuations in the system, e.g. in case more helium is pumped out of the first helium tank than can be instantly liquefied by the refrigerator or vice versa. The pressure compensation container thereby serves a buffering function.

In a further advantageous embodiment of the invention, a heating device is provided in the second helium tank to heat the helium. This is particularly advantageous if the refrigerator liquefies more helium than can be pumped out of the system via the further cooling unit. The heating device can regulate the amount of liquefied helium to thereby create a stable operating state. At the same time, the regulated heating device can keep the pressure in the second chamber and thereby also the pressure in the first chamber at a constant level.

It is moreover advantageous to provide the cryostat with a means for filling-in helium which is at least connected to a helium tank, preferably to the second helium tank. If e.g. helium has escaped from the loop e.g. via an overpressure valve, that helium can be refilled.

In a particularly advantageous embodiment of the inventive cryostat, the second helium tank contains liquid helium at a temperature of approximately 4.2 K, and the two helium tanks are connected such that the helium in both helium tanks is at an increased pressure level $p_1$ compared to atmospheric pressure $p_0$. The slight overpressure in the helium tank prevents surrounding air from reaching the helium tank. The difference of the two pressure levels $p_1$ and $p_0$ is thereby less than 100 mbar, preferably approximately 50 mbar.

In a further development of this embodiment, means are provided for opening an overpressure valve on the second helium tank towards the surroundings in the event that the refrigerator fails, in such a manner that helium which evaporates from the second helium tank is guided past the refrigerator thereby discharging enthalpy to the refrigerator to thereby minimize the heat input into the second helium tank. The helium evaporated due to refrigerator failure can escape from the helium tank while cooling the refrigerator and the wall of the suspended conduit in which the refrigerator is disposed, to reduce heat input into the second tank. In case of disturbance, the magnet arrangement located in the cryostat may thereby be operated without additional expense for a much longer time than would be possible without utilizing the enthalpy of the evaporated helium to cool the refrigerator, which is generally located in a tower of the cryostat, and the surrounding walls. During normal operation, no helium is discharged through this tower and cooling is effected only by the refrigerator. The supplied helium which is pumped from the first tank can cool the other towers of the cryostat.

In a particularly preferred further development of the inventive cryostat, a line for the supplied helium is connected to the overpressure valve such that, when the overpressure valve opens, the supplied helium is also directly discharged to the surroundings. If the refrigerator fails, it can no longer liquefy the supplied helium which would then reach the helium tank at an increased temperature thereby producing additional and undesired heat input.

The cryostat is preferably part of an apparatus of magnetic resonance such as an NMR spectrometer, a nuclear magnetic resonance tomograph or an ICR mass spectrometer. These devices require a particularly homogeneous, stable and undisturbed magnetic field in a volume under investigation, and therefore optimally profit from the advantages of the inventive magnet system.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

DESCRIPTION OF THE PREFERRED EMBODIMENT

Figure 1:
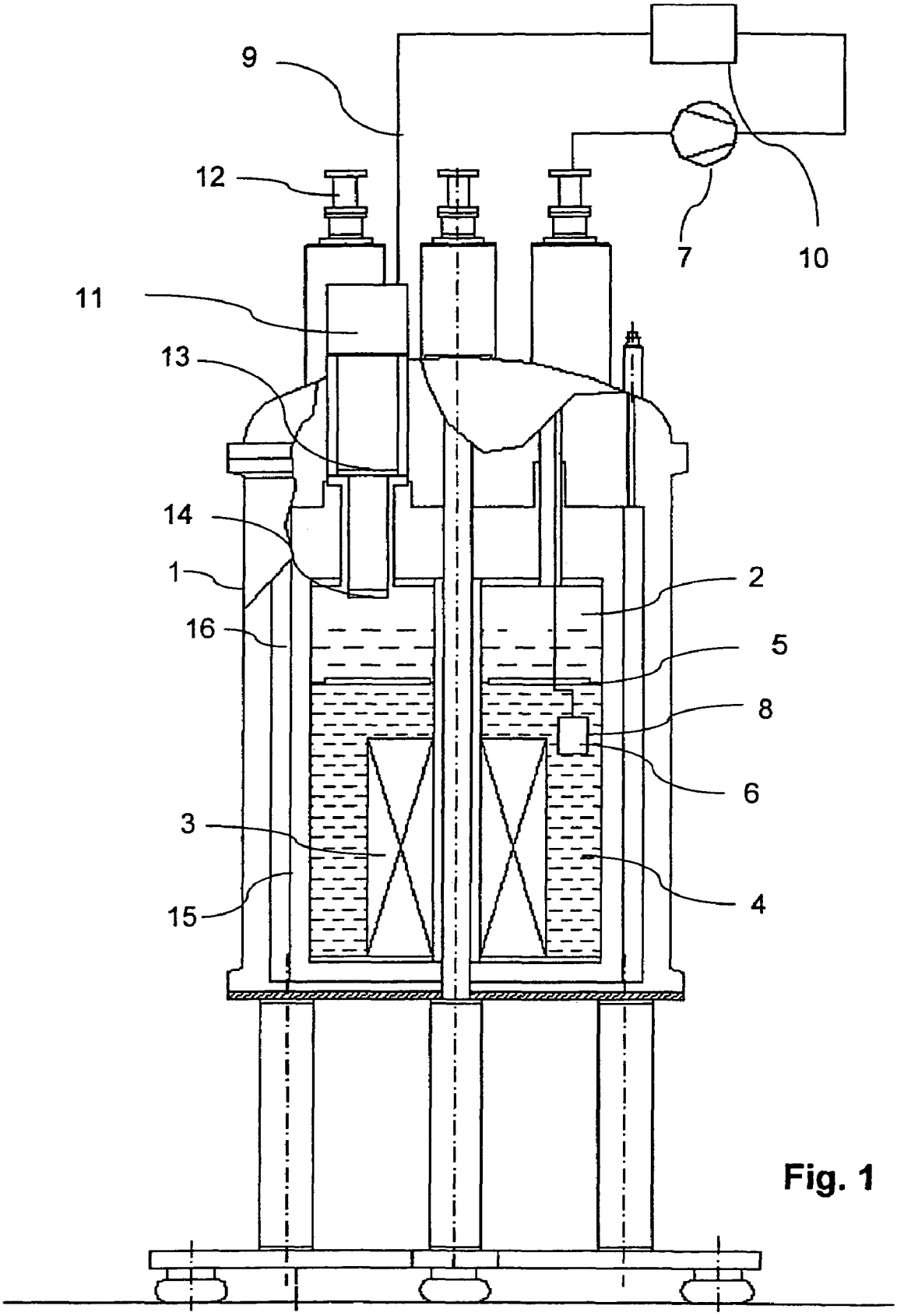
FIG. 1 shows a schematic illustration of an inventive cryostat with installed refrigerator.

FIG. 1 shows an inventive cryostat 1 with a first helium tank 4 which is disposed in the cryostat 1 and which contains a magnet coil 3 for generating a highly homogeneous magnetic field. A second helium tank 2 is disposed above the first helium tank 4 and is separated from the first helium tank 4 by a thermal barrier 5. The second helium tank 2 contains liquid helium at atmospheric pressure $p_0$ or at a pressure level $p_1$ which is slightly higher than atmospheric pressure $p_0$ and at a temperature of more than 3K, preferably 4.2 K. The two helium tanks 2, 4 communicate with each other such that helium can flow from the upper, second helium tank 2 into the lower, first helium tank 4 where the helium is further cooled (undercooled) to a temperature of considerably less than 3 K, preferably 1.8 K, using a cooling means. Towards this end, the helium is pumped via the cooling means 6 through a pump 7 and is expanded using a Joule-Thomson valve. A heat exchanger which may be designed in the form of the surface 8 of the cooling means 6 undercools the helium in the first helium tank 4. The expanded helium which is pumped via the cooling means 6 is guided via a return line 9 into a pressure compensating container 10 and then guided into the second helium tank 2. The expanded helium is thereby returned along a refrigerator 11 which liquefies and cools the expanded helium to 4.2 K. The helium which was removed via the cooling means 6 is therefore returned to the second helium tank 2 through a closed loop such that refilling of the second helium tank 2 is not required during normal operation. The magnet system disposed in the cryostat in FIG. 1 is part of a high-resolution NMR spectrometer with high magnetic field strength in the range of 18 Tesla or more.

The inventive cryostat improves measuring operation, since the number of helium refilling processes can be considerably reduced. The second helium tank 2 which contains a relatively large supply of helium in conventional magnet systems may therefore be considerably smaller in the inventive magnet system. The second helium tank 2 thereby mainly, serves a hydrostatic function, namely maintenance of the atmospheric pressure or increased pressure level in the first helium tank 4.

The pressure compensation container 10 compensates for pressure fluctuations within the return line 9. If e.g. more helium is pumped by the pump 7 through the cooling means 6 than is liquefied through the refrigerator 11 in the second helium tank 2, the excess helium is stored in the pressure compensation container 10. Vice versa, if the refrigerator 11 liquefies more helium than is pumped from the first helium tank 4, the magnet system advantageously comprises a heating device for regulating the liquefied amount of the refrigerator 11. The inventive system should thereby be set such that the refrigerator 11 liquefies more helium when the heating device is switched off than is supplied by the pump 7 through the cooling means 6. The heating device can therefore produce a balance within the return line 9 in a simple fashion. It is, in principle, also feasible to regulate the equilibrium within the return line 9 via the power of the pump 7 or through changing the operating frequency of the pulse tube cooler or of its cold stage.

The refrigerator 11 of FIG. 1 has two stages to cool the helium to its boiling temperature. The first stage 13 of the refrigerator 11 can thereby be thermally conductingly connected to a radiation shield 15 disposed in the cryostat. The radiation shield 15 serves to reduce impinging radiation energy and is usually designed, at least partially, as a nitrogen tank 16 which keeps the radiation shield 15 at approximately 40 K. Through thermal connection of the radiation shield 15 and the refrigerator 11, the radiation shield 15 can be cooled via the refrigerator 11 and a nitrogen tank 16 can be omitted. Through this means and through reduction of the size of the second helium tank 2, the design of the inventive cryostat may be more compact compared to conventional cryostats. The cold end of the second stage 14 of the pulse tube cooler 11 projects into the second helium tank 2 to cool the helium located in the second tank and bring the returned helium to its boiling temperature for liquefaction thereof.

Figure 2:
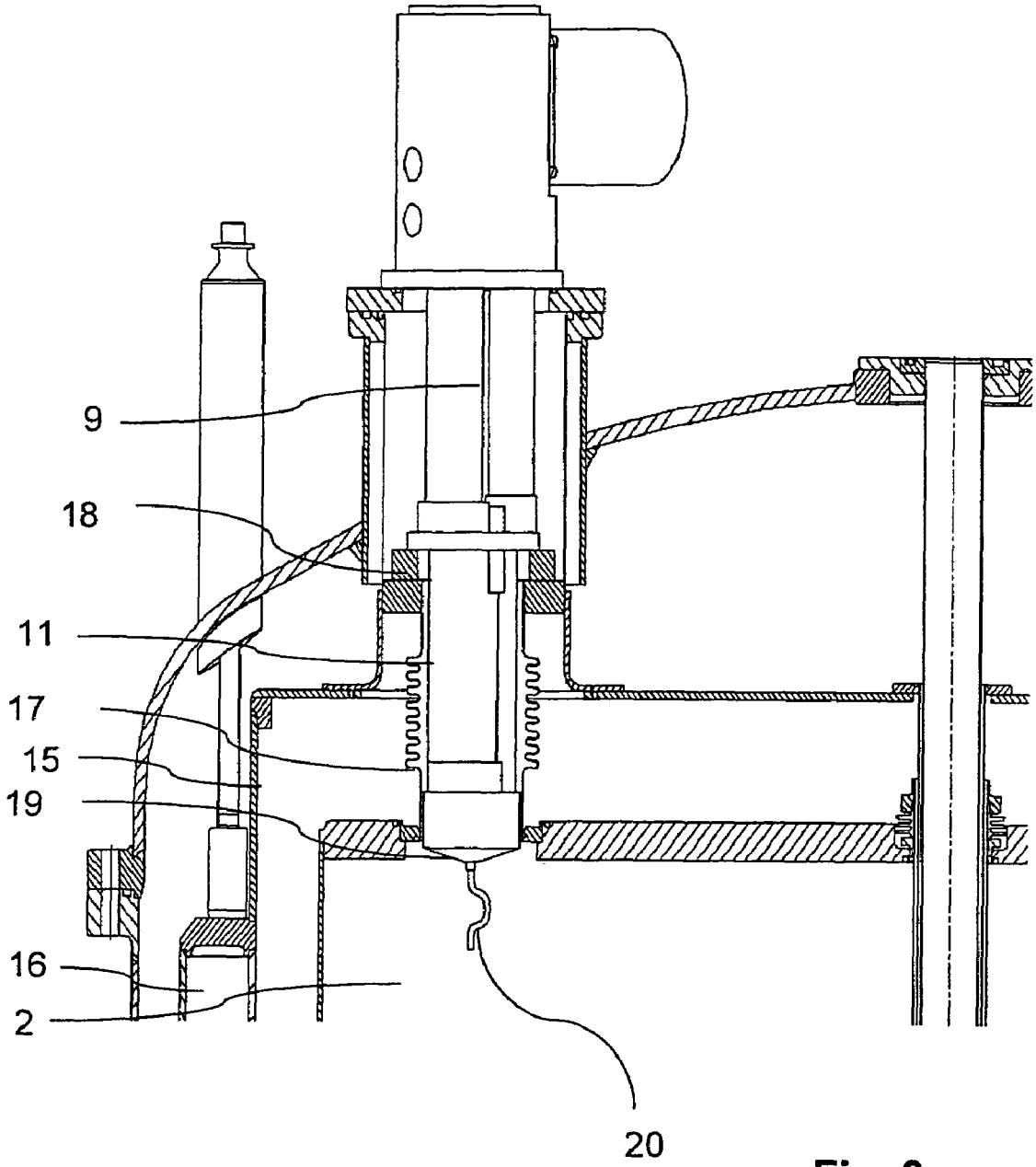
FIG. 2 shows a detailed schematic illustration of the refrigerator installed in the inventive cryostat.

FIG. 2 shows a detailed illustration of the refrigerator 11 installed in the magnet system. A separation from the vacuum 17 projects from the second helium tank 2 through the radiation shield 15. The refrigerator 11 is located within the separation from the vacuum 17 and is thermally conductingly mounted thereto using a flange connection 18. The helium pumped via the cooling means 6 is guided via the return line 9 via the refrigerator (not shown) into the cold end 19 of the refrigerator 11 where it is liquefied and returned to the second helium tank 2 through the outlet 20.

To generate the lower temperatures required to liquefy helium, the refrigerator 11 comprises a regenerator material with a phase transition. The phase transition increases the volumetric specific heat of the regenerator material and permits cooling of the helium to less than 3 K. Suitable regenerator materials are Pb and rare earth compounds such as e.g. HoCo, $Er_3Ni$, ErNi, $GdAlO_3$ and $ErNi_{0.9}Co_{0.1}$. However, these materials have a magnetic phase transition which may cause disturbances in magnetic applications. The inventive magnet system thereby provides magnetic shielding of the regenerator material in the cryostat 1. This may be effected e.g. using a highly permeable sheet which surrounds the refrigerator 11 or only the regenerator housing or through an electrically highly conducting housing which eliminates the fluctuating magnetization. It is also feasible to provide a superconducting housing about the refrigerator 11. As is shown in FIG. 1, the refrigerator 11 is disposed at a relatively large separation from the magnet coil 3 such that the influence of the above-mentioned disturbing effects resulting from the magnetic phase transition of the regenerator material are minimized.

For safety reasons, the inventive cryostat 1 may be provided with an overpressure valve through which helium may escape into the atmosphere should the helium be heated e.g. due to a quench of the magnet coil 3 or through failure of the refrigerator 11. This prevents undesired increase of the pressure within the helium tank. In this case, helium may have to be refilled into the second helium tank 2. This may be done via a fill-in means 12. In order to save space in conventional cryostats, the overpressure valve is disposed in a neck or suspension tube in which no refrigerator is installed such that the excessive evaporated helium escapes to the atmosphere through gaps in the neck or suspension tubes.

If the refrigerator 11 fails, the helium supplied through the line 9 is no longer liquefied and heat is input into the second helium tank 2 via the supplied helium as well as via the refrigerator 11 itself. In this event, the helium consumption increases dramatically (up to 100 liters in one weekend). As a result, the cooling of the magnet arrangement is no longer sufficient and operation must be interrupted or a very large helium tank must be used to prevent failure of the overall apparatus.

Figure 3:
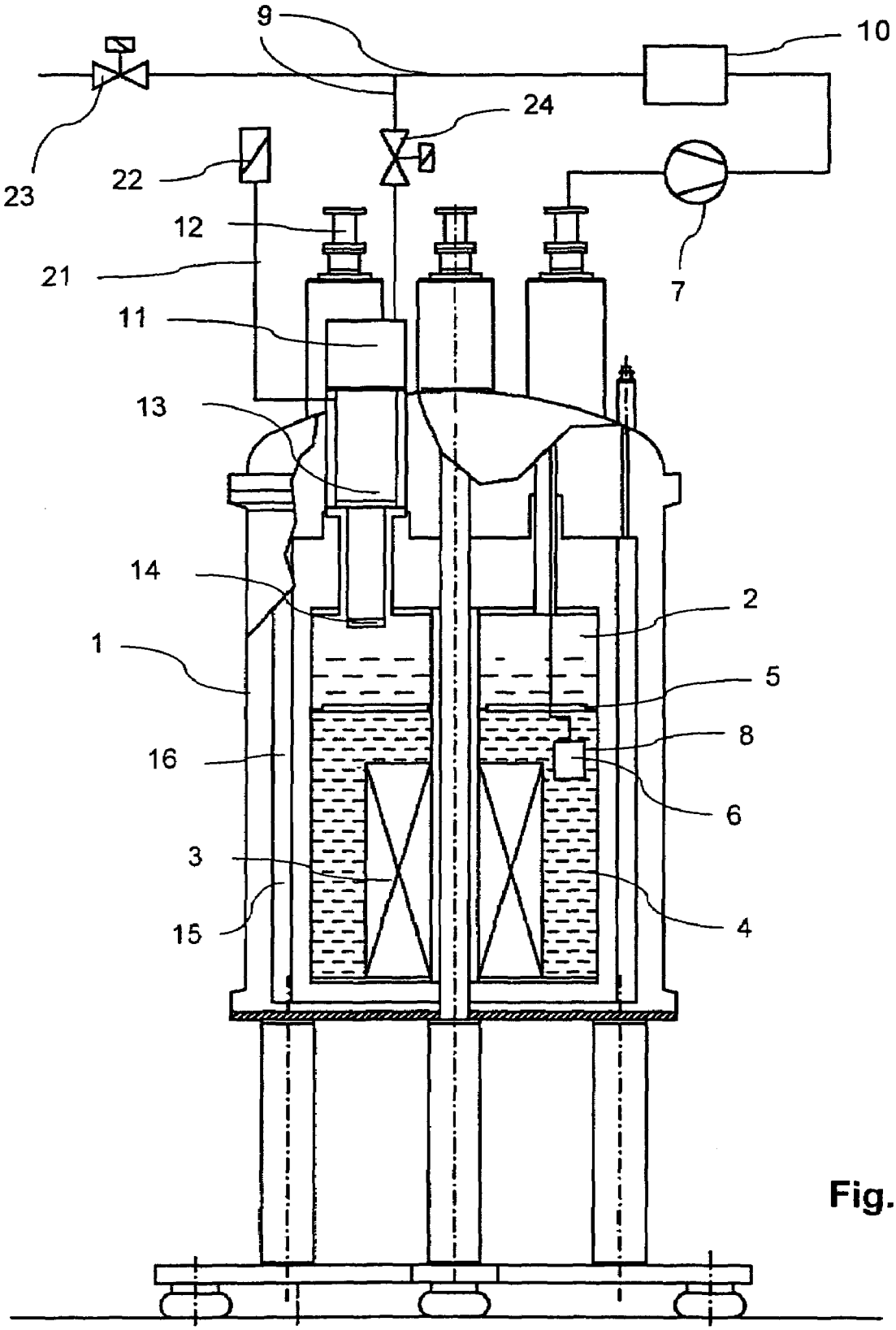
FIG. 3 shows a schematic illustration of an inventive cryostat with overpressure valve on the second helium tank.

FIG. 3 shows an advantageous further development of the cryostat 1 shown in FIG. 1, wherein an overpressure valve 22 opens to the surroundings in case the refrigerator 11 fails such that helium evaporated from the second helium tank 2 is guided past the refrigerator 11. The evaporated helium is discharged to the atmosphere via a line 21. The helium vapor flow past the refrigerator 11 produces an enthalpy transfer from the helium vapor to the refrigerator 11, the suspension, and to the walls of the suspension tube, thereby cooling these structures. Heat input via the (non-active) refrigerator 11 is thereby substantially reduced, such that the cryostat 1 is in a state which is similar to that of a cryostat without a refrigerator 11. In the embodiment of FIG. 3, the line 9 is additionally provided with a further valve 23 and a valve 24 to prevent additional heat input into the second helium tank 2 via the (warm) helium pumped from the first helium tank 4 into line 9. When the overpressure valve 22 opens, the helium supplied through the line 9 is also directly discharged to the surroundings via a valve 23. The valve 23 is designed as a check valve to prevent surrounding air from getting into the cryostat, and opens in case the refrigerator 11 fails or if the overpressure valve 22 opens. The valve 24 closes at the same time or with a delay to prevent reflux of the helium streaming through the pump into the second helium tank 2. The cryostat 1 can thereby be operated in two operating modes, namely in normal operation and disturbed operation. If the refrigerator 11 fails, the valves 23 and 24 (preferably solenoid valves) switch from normal operation to disturbed operation. This embodiment permits operation of the cryostat for a relatively long time even in case of disturbance, since the helium consumption is not excessively increased by the structures in the region (tower) of the refrigerator 11 which would otherwise produce large heat input into the second helium tank 2. The inventive cryostat 1 decisively reduces this heat input into the second helium tank 2 in the above-mentioned manner, and thereby permits more compact design of the cryostat 1, which can therefore be operated for a long time even when the refrigerator 11 has failed.

A compact magnet system is thereby obtained which permits continuous measuring operation and largely omits supply and inconvenient refilling of helium by the staff.

LIST OF REFERENCE NUMERALS

1 cryostat
2 second helium tank
3 magnet coil
4 first helium tank
5 thermal barrier
6 cooling means
7 pump
8 surface of the cooling means
9 return line
10 pressure compensation container
11 refrigerator
12 fill-in means (tower)
13 first stage of the pulse tube cooler
14 second stage of the pulse tube cooler
15 radiation shield
16 nitrogen tank
17 separation from the vacuum
18 flange connection
19 cold end of the pulse tube cooler
20 outlet for liquefied helium
21 line
22 overpressure valve
23 overpressure and return valve
24 valve

I claim:

1. A cryostat, the cryostat comprising:

a first helium tank, said first helium tank containing liquid helium at an operating temperature $T_1<3K$;

a second helium tank connected to said first helium tank, said second helium tank containing liquid helium at an operating temperature $T_2>3K$;

a cooling means disposed in said first helium tank for generating said operating temperature $T_1>3K$, said cooling means comprising a Joule-Thomson valve with downstream heat exchanger from which pumped helium is passed to a room temperature region outside of the cryostat;

a refrigerator having a cold end projecting into said second helium tank; and means for circulating said pumped helium from said first tank, through the room temperature region, along said refrigerator, and into said second helium tank, wherein said pumped helium is cooled and liquefied at said cold end of said refrigerator.

2. The cryostat of claim 1, wherein said first helium tank is structured and dimensioned to contain a superconducting magnet system.

3. The cryostat of claim 2, wherein said superconducting magnet system is structured and dimensioned for a magnetic resonance apparatus.

4. The cryostat of claim 1, wherein said refrigerator is a pulse tube cooler.

5. The cryostat of claim 1, wherein said refrigerator comprises a plurality of stages.

6. The cryostat of claim 5, wherein said refrigerator comprises two stages.

7. The cryostat of claim 5, further comprising a radiation shield disposed in the cryostat, wherein a stage of said refrigerator upstream of said cold end is thermally conductingly connected to said radiation shield.

8. The cryostat of claim 7, wherein said radiation shield is connected to a first stage of said refrigerator, said radiation shield surrounding said first and said second helium tanks, said refrigerator having a cooling power which is sufficient to replace a tank of liquid nitrogen.

9. The cryostat of claim 1, wherein said refrigerator contains a regenerator material substance having a phase transition or having a magnetic phase transition.

10. The cryostat of claim 9, further comprising means for magnetically shielding said regenerator material in the cryostat.

11. The cryostat or claim 1, wherein said refrigerator contains a regenerator material substance having a non-magnetic phase transition.

12. The cryostat of claim 1, wherein said refrigerator contains helium as regenerator material.

13. The cryostat of claim 1, wherein a section of said refrigerator containing regenerator is disposed at a location in the cryostat which has a minimum magnetic field.

14. The cryostat of claim 1, wherein the cryostat and said refrigerator are structured and dimensioned such that no helium must be refilled into the cryostat during operation thereof.

15. The cryostat of claim 1, wherein said second helium tank is disposed above said first helium tank.

16. A cryostat, the cryostat comprising:

a first helium tank, said first helium tank containing liquid helium at an operating temperature $T_1$<3K;

a second helium tank connected to said first helium tank, said second helium tank containing liquid helium at an operating temperature $T_2$>3K;

a cooling means disposed in said first helium tank for generating said operating temperature $T_1$<3K said cooling means comprising a Joule-Thomson valve with downstream heat exchanger from which pumped helium is passed to a room temperature region outside of the cryostat;

a refrigerator having a cold end projecting into said second helium tank; and means for circulating said pumped helium from said first tank, through the room temperature region, along said refrigerator, and into said second helium tank, wherein said pumped helium is cooled and liquefied at said cold end of said refrigerator, wherein said circulating means comprises a return line to return the pumped helium, said return line having a pressure compensation container or having a pressure compensation chamber which is disposed outside of the cryostat.

17. The cryostat of claim 1, further comprising a heating device disposed in said second helium tank to heat helium contained therein.

18. The cryostat of claim 1, further comprising means for filling-in helium, said filling-in means disposed on the cryostat and connected to at least one of said first and said second helium tanks.

19. The cryostat of claim 1, wherein said second helium tank contains liquid helium at a temperature of approximately 4.2 K, wherein said first and said second helium tanks are connected such that helium in both helium tanks is at a pressure level $p_1$ which is slightly higher than atmospheric pressure $P_0$.

20. A cryostat, the cryostat comprising:

a first helium tank, said first helium tank containing liquid helium at an operating temperature $T_1$<3K;

a second helium tank connected to said first helium tank, said second helium tank containing liquid helium at an operating temperature $T_2$>3K;

a cooling means disposed in said first helium tank for generating said operating temperature $T_1$<3K, said cooling means comprising a Joule-Thomson valve with downstream heat exchanger from which pumped helium is passed to a room temperature region outside of the cryostat;

a refrigerator having a cold end projecting into said second helium tank;

means for circulating said pumped helium from said first tank, through the room temperature region, along said refrigerator, and into said second helium tank, wherein said pumped helium is cooled and liquefied at said cold end of said refrigerator; means for filling-in helium, said filling-in means disposed on the cryostat and connected to at least one of said first and said second helium tanks; and means for venting an overpressure valve at said second helium tank such that helium evaporated from said second helium tank is guided along said refrigerator to discharge enthalpy to said refrigerator for minimizing heat input into said second helium tank when said refrigerator fails.

* * * * *